US005880392A

United States Patent [19]

Wessel et al.

[11] Patent Number: 5,880,392

[45] Date of Patent: Mar. 9, 1999

[54] CONTROL STRUCTURE FOR SOUND SYNTHESIS

[75] Inventors: David Wessel, Berkeley; Michael Lee, Hayward, both of Calif.

[73] Assignee: The Regents of the University of California, Oakland, Calif.

[21] Appl. No.: 756,935

[22] Filed: Dec. 2, 1996

Related U.S. Application Data

[63] Continuation of Ser. No. 551,890, Oct. 23, 1995.

[51] Int. Cl.[6] ..... G10H 1/08; G10H 1/10

[52] U.S. Cl. ..... 84/659; 84/622; 84/623; 84/626; 84/662

[58] Field of Search ..... 84/622–625, 659–661, 84/626–633, 662–665

[56] References Cited

U.S. PATENT DOCUMENTS

| | | |
|---|---|---|
| 5,029,509 | 7/1991 | Serra et al. . |
| 5,138,924 | 8/1992 | Ohya et al. . |
| 5,138,927 | 8/1992 | Nishimoto . |
| 5,138,928 | 8/1992 | Nakajima et al. . |

OTHER PUBLICATIONS

Borisyuk, "A Model of the Neural Network For Storage And Retrieval Of Temporal Sequences", *Institute of Mathematical Problems of Biology, Russia Academy of Sciences.*

Rahim, "Artificial Neural Networks for Speech Analysis/Synthesis" *AT&T Bell Laboratories, Chapman & Hall Neural Computing Series.*

Wessel, Instruments That Learn, Refined Controllers, and Sourch Model Loudspeakers *Computer Music Journal, Massachusetts Institute of Technology*, 15(4):82–86 (1991).

Wessel, "Timbre Space as a Musical Control Structure", Originally published in *Computer Music Journal* 3(2):45–52 (1979).

*Primary Examiner*—William M. Shoop, Jr.
*Assistant Examiner*—Marlon Fletcher
*Attorney, Agent, or Firm*—Burns, Doane, Swecker & Mathis, L.L.P.

[57] ABSTRACT

An improved control structure for music synthesis is provided in which: 1) the sound representation provided to the adaptive function mapper allows for a greatly increased degree of control over the sound produced; and 2) training of the adaptive function mapper is performed using an error measure, or error norm, that greatly facilitates learning while ensuring perceptual identity of the produced sound with the training example. In accordance with one embodiment of the invention, sound data is produced by applying to an adaptive function mapper control parameters including: at least one parameter selected from the set of time and timbre space coordinates; and at least one parameter selected from the set of pitch, Δpitch, articulation and dynamic. Using an adaptive function mapper, mapping is performed from the control parameters to synthesis parameters to be applied to a sound synthesizer. In accordance with another embodiment of the invention, an adaptive function mapper is trained to produce, in accordance with information stored in a mapping store, synthesis parameters to be applied to a sound synthesizer, by steps including: analyzing sounds to produce sound parameters describing the sounds; further analyzing the sound parameters to produce control parameters; applying the control parameters to the adaptive function mapper, the adaptive function mapper in response producing trial synthesis parameters comparable to the sound parameters; deriving from the sound parameters and the trial synthesis parameters an error measure in accordance with a perceptual error norm in which at least some error contributions are weighted in approximate degree to which they are perceived by the human ear during synthesis; and adapting the information stored in the mapping store in accordance with the error measure.

30 Claims, 8 Drawing Sheets

CONTROL STRUCTURE FOR SOUND SYNTHESIS

This application is a continuation of application Ser. No. 08/551,890, filed Oct. 23, 1995.

BACKGROUND OF THE INVENTION

1. Field of the Invention

The present invention relates to control structures for computer-controlled sound synthesis.

2. State of the Art

The application of computers to sound synthesis has been studied and practiced for many years. Whereas the computer synthesis of simple sounds is straightforward, the problem of synthesizing complex, realistic sounds such as the human voice, the sound of a piano chord being played, a bird call, etc., has posed a continuing challenge.

One well-known technique of synthesizing complex sounds is that of additive synthesis. In conventional additive synthesis, a collection of sinusoidal partials is added together to produce a complex sound. To produce a complex, realistic sound may require as many as 1000 sinusoidal partials to be added together. Each sinusoidal partial must be specified by at least frequency and amplitude, and possibly phase. Clearly, the computational challenge posed in producing complex, realistic sounds by additive synthesis is considerable.

Furthermore, the greatest benefit is obtained when additive synthesis is used to produce complex, realistic sounds in real time. That is, the synthesis system should be able to accept a series of records each specifying the parameters for a large number of partials and to produce from those records a complex, interesting, realistic sound without any user-perceptible delay.

Two approaches to additive synthesis have been followed. In the first approach (the time-domain, or wavetable, approach), the equivalent of a bank of oscillators has been used to directly generate sinusoidal partials. The frequency and amplitude values of all of the partials have been applied to the oscillators in the oscillator bank, and the resulting partials have been added together to produce the final sound. The requirement of directly computing each partial individually has limited the number of partials that may be included in a sound so as to allow the sound to be produced in a reasonable period of time.

In the second approach (the frequency-domain approach), partials have been specified and added in the frequency domain to produce a spectrum, or frequency-domain representation, of the final sound. The inverse Fourier transform is then used to compute the time-domain representation of the final sound, from which the sound is then produced.

An IFFT additive synthesis technique is described in U.S. Pat. No. 5,401,897, incorporated herein by reference. In the described additive sound synthesis process, sample blocks are determined by carrying out the inverse Fourier transform of successive frequency spectra. The sample blocks are time-superimposed and added to form a sequence of samples representing a sound wave. The latter procedure is known as overlap-add.

Other patents relating to additive sound synthesis include the following: U.S. Pat. No. 4,856,068; U.S. Pat. No. 4,885,790; U.S. Pat. No. 4,937,873; U.S. Pat. No. 5,029,509; U.S. Pat. No. 5,054,072; and U.S. Pat. No. 5,327,518; all of which are incorporated herein by reference.

Prior art additive synthesis methods of the type described, however, have remained limited in several respects. Many of these limitations are addressed and overcome in copending U.S. patent application Ser. No. 08/551,889 (Attorney's Docket No. 028726-008), entitled Inverse Transform Narrow Band/Broad Band Additive Synthesis, filed on even date herewith and incorporated herein by reference. Not addressed in the foregoing patent application is the problem of constructing a suitable control structure that may be used to control additive sound synthesis in real time. Prior art methods have typically been limited to generating and playing sound described by pre-stored, analyzed parameters rather than values that change in real time during synthesis.

As recognized by the present inventors, the problem of constructing a suitable control structure that may be used to control additive sound synthesis in real time involves two sub-problems. One problem is to provide a user interface that may be readily understood and that requires only a minimum of control input signals. In other words, the user interface must offer simplicity to the user. Another problem is to translate this simplicity seen by the user into the complexity often required by the synthesizer and to do so in a time-efficient and hardware-efficient manner.

An important contribution to the user interface problem is found in Wessel, Timbre Space as a Musical Control Structure, *Computer Music Journal* 3 (2): 45–52, 1979, incorporated herein by reference. A fundamental musical property is that of timbre, i.e., the tone and quality of sound produced by a particular instrument. For example, a violin and a saxophone each have distinctively different timbres that are readily recognizable. The foregoing paper describes how to construct a perceptually uniform timbre space.

A timbre space is a geometric representation wherein particular sounds with certain qualities or timbres are represented as points. The timbre space is said to be perceptually uniform if sounds of similar timbre or quality are proximate in the space and sounds with marked difference in timbre or quality are distant. In such a perceptually uniform timbre space, perceptual similarity of timbres is inversely related to distance.

The basic idea is that by specifying coordinates in a particular timbre space, one is able to hear the timbre represented by those coordinates (e.g., a violin). If these coordinates should fall between existing tones in the space (e.g., in between a violin and a saxophone), an interpolated timbre results that relates to the other sounds in a manner consistent with the structure of the space. Smooth, finely graded timbral transitions can thus be formed, with the distance moved within the timbre space bearing a uniform relationship to the audible change in timbre.

Also discussed in the paper is the need to reduce the considerable quantity of data required by a general synthesis techniques such as additive synthesis without sacrificing richness in the sonic result. The approach suggested is the use of straight-line-segment approximations to approximate curvilinear envelope functions.

More recently, advances in machine learning techniques such as neural networks have been applied to the second sub-problem, that is translating the simplicity seen by the user into the complexity often required by the synthesizer and to do so in a time-efficient and hardware-efficient manner. Neural networks may be considered to be representative of a broader class of adaptive function mappers that map musical control parameters to the parameters of a synthesis algorithm. The synthesis algorithm typically has a large number of input parameters. The user interface, also referred to as the gestural interface, typically supplies fewer parameters. The adaptive function mapper is therefore required to map from a low dimensional space to a high dimensional space.

The use of a neural network in an electronic musical instrument is described in U.S. Pat. No. 5,138,924, incorporated herein by reference. Referring to FIG. 1, in accordance with the foregoing patent, a neural network 134 is used to translate user inputs from a wind controller 135 to outputs used by a synthesizer 137 of an electronic musical instrument. The synthesizer 137 is shown as being an oscillator bank. In operation, the player blows in breath from the mouthpiece 140, and controls the key system 141 with the fingers of both hands to play the instrument. Each key composing the key system 141 is an electronic switch. The ON/OFF signals caused by operation are input to the input layer 142 of the neural network 134. The neural network 134 is a hierarchical neural network having four layers, namely an input layer 142, a first intermediate layer 143, a second intermediate layer 144, and an output layer 145.

The number of neurons of the output layer 145 is equal to the number of oscillators 146 and attenuators 147. Each pair of neurons of the output layer 145 outputs the frequency control signal of the sine wave to be generated to the respective oscillator 146 and an amplitude control signal to the corresponding attenuator 147. The sine wave generated by the oscillator is attenuated to the specified amplitude value and input to an adding circuit 148. In the adding circuit 148 all the sine waves are added together with the resulting synthesis signal being input to the D/A converter 149. In the D/A converter 149 the synthesis signal is shaped to obtain a smooth envelope and is then output as a musical sound, which is amplified by a sound system (not shown).

In the foregoing arrangement, because additive synthesis is used, it is possible to use the results of analysis by FFT as training patterns for the neural network. That is, a musical tone of a specific pitch of the musical instrument to be learned is FFT-analyzed, and the results of the FFT (to which the ON/OFF pattern used to generate the tone corresponds) is input to the neural network as a training pattern. This process is performed for the entire range of tones to be produced.

Many of the techniques employed in additive music synthesis have been adopted from work in the area of speech analysis and synthesis. Further information regarding the application of neural networks and machine learning techniques to music synthesis can be found in Rahim, *Artificial Neural Networks for Speech Analysis/Synthesis,* Chapman & Hall, 199?.

Despite the known use of adaptive function mappers that map musical control parameters to the parameters of a synthesis algorithm, there remains a need for an improved control structure for music synthesis in which: 1) the sound representation provided to the adaptive function mapper allows for a greatly increased degree of control over the sound produced; and 2) training of the adaptive function mapper is performed using an error measure, or error norm, that greatly facilitates learning while ensuring perceptual identity of the produced sound with the training example. The present invention addresses this need.

SUMMARY OF THE INVENTION

The present invention, generally speaking, provides for an improved control structure for music synthesis in which: 1) the sound representation provided to the adaptive function mapper allows for a greatly increased degree of control over the sound produced; and 2) training of the adaptive function mapper is performed using an error measure, or error norm, that greatly facilitates learning while ensuring perceptual identity of the produced sound with the training example. In accordance with one embodiment of the invention, sound data is produced by applying to an adaptive function mapper control parameters including: at least one parameter selected from the set of time and timbre space coordinates; and at least one parameter selected from the set of pitch, Δpitch, articulation and dynamic. Using the adaptive function mapper, mapping is performed from the control parameters to synthesis parameters to be applied to a sound synthesizer. In accordance with another embodiment of the invention, an adaptive function mapper is trained to produce, in accordance with information stored in a mapping store, synthesis parameters to be applied to a sound synthesizer, by steps including: analyzing sounds to produce sound parameters describing the sounds; further analyzing the sound parameters to produce control parameters; applying the control parameters to the adaptive function mapper, the adaptive function mapper in response producing trial synthesis parameters comparable to the sound parameters; deriving from the sound parameters and the trial synthesis parameters an error measure in accordance with a perceptual error norm in which at least some error contributions are weighted in approximate degree to which they are perceived by the human ear during synthesis; and adapting the information stored in the mapping store in accordance with the error measure.

BRIEF DESCRIPTION OF THE DRAWING

The present invention may be further understood from the following description in conjunction with the appended drawing. In the drawing.

DETAILED DESCRIPTION OF THE PREFERRED EMBODIMENTS

In the following description, a clear separation is observed between sound synthesis per se and the distinct problem of producing parameters to be used to control sound synthesis so as to obtain production of a desired sound. The present control structure produces appropriate parameters for sound synthesis which is then assumed to be performed by an appropriate sound synthesizer, such as that described in the aforementioned copending U.S. application Ser. No. 08/551,889. Preferably, the synthesizer is capable of real-time operation so as to respond with nearly imperceptible delay to user inputs, as from a keyboard, footpedal, or other input device. Of course, the present invention is broadly applicable to sound synthesizers of all types. Hence, the description of the sound synthesizer that follows should be regarded as merely exemplary of a sound synthesizer with which the present invention may be used.

Figure 2:
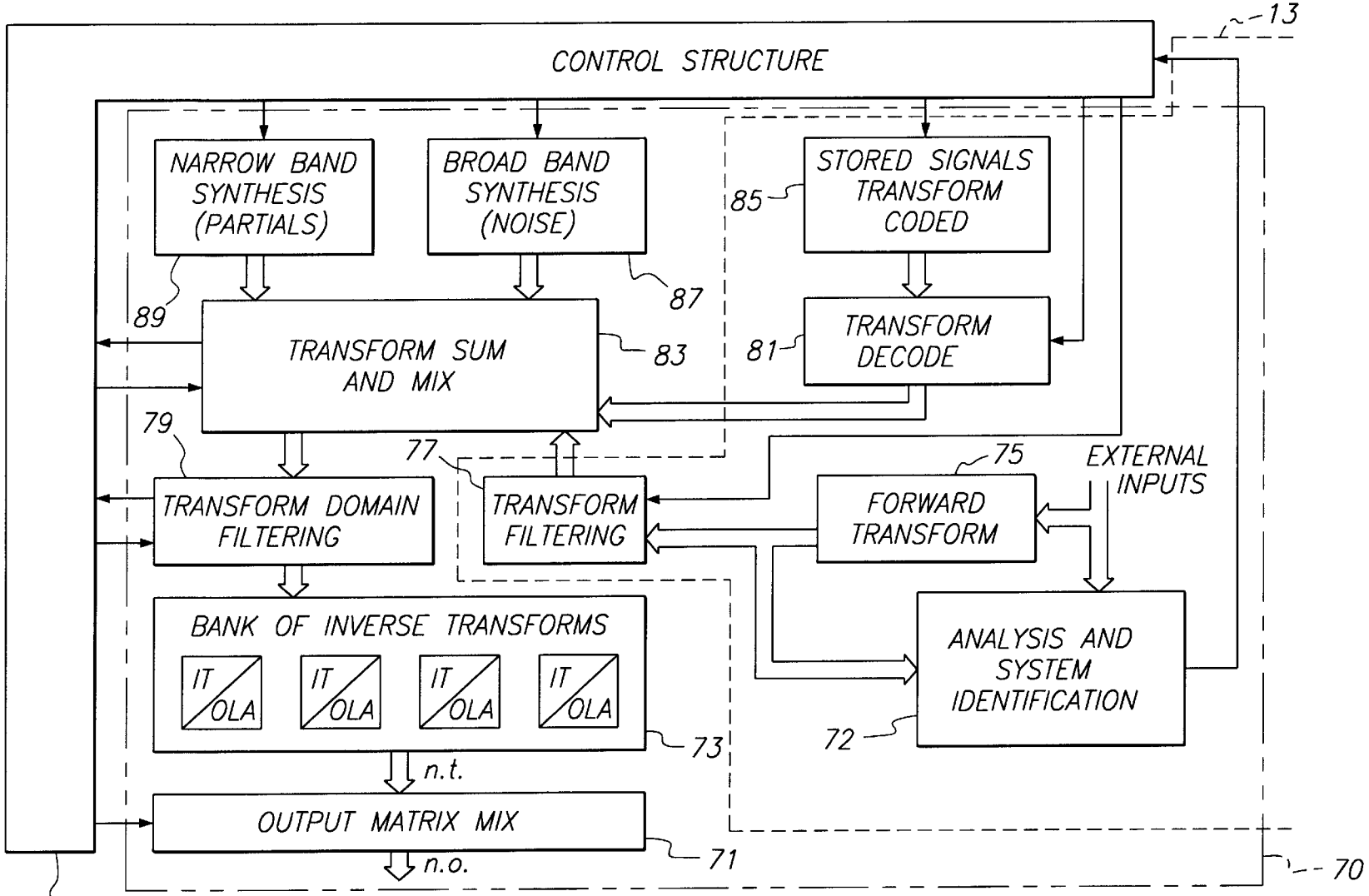
FIG. 2 is an overall block diagram of an inverse transform additive sound synthesis system in which the present invention may be used.

Referring now to FIG. 2, a control structure 500 is shown in relation to such a synthesizer. The control structure 500 provides parameters to various blocks of the sound synthesis system, which will be briefly described. The architecture of the system is designed so as to realize an extremely versatile sound synthesis system suitable for a wide variety of applications. Hence, certain blocks are provided whose functions may be omitted in a simpler sound synthesis system. Such blocks appear to the right of the dashed line 13 in FIG. 2. The function of the remaining blocks in FIG. 2 will therefore be described first.

In the prior art inverse transform additive sound synthesis system of U.S. Pat. No. 5,401,897, and in other conventional additive sound synthesis systems, a frequency spectrum is obtained by adding discrete spectral components grouped in spectral envelopes. Each spectral envelope corresponds to a sinusoidal component or a spectral noise band. Noise bands are statistically independent, i.e., generated by a mechanism independently defined and unrelated to the mechanism by which the sinusoidal components are generated.

In the inverse transform additive sound synthesis system of FIG. 2, on the other hand, partials need not be sinusoidal but may assume any of various forms of narrow band components. Hence, the terms "spectrum", "spectra" and "spectral" usually used in describing sound synthesizers apply to the synthesizer of FIG. 2 only in the broad sense as connoting a sound representation in a domain other than the time domain, and do not necessarily connote representation in terms of sinusoidal components. Furthermore, broad band components, rather than being defined independently of the narrowband components, may be generated such that the broad-band-component generating mechanism is bound up in the narrow-band-component generating mechanism. Consequently, the blocks 89 and 87 in FIG. 2, although they may be considered to bear a superficial correspondence with the prior art mechanisms of generating sinusoidal partials and noise bands, respectively, should be thought of more generally as performing narrow-band synthesis (89) and broad-band synthesis (87). The narrow-band synthesis block 89 and the broad-band synthesis block 87 are controlled by control signals from the control structure 500.

Narrow-band components and broad-band components are added together in a transform sum-and mix-block 83. The transform sum-and-mix block 83 is controlled by control signals from the control structure 500. The transform sum-and-mix block 83 allows for selective distribution, or "dosing," of energy in a given partial between separate transform sums. This feature provides the capability for polyphonic effects.

The transform sum-and-mix block also provides signals to the control structure 500. Considerable advantage may be obtained by, for example, using the spectral representation found in one or more of the transform sums to provide a real-time visual display of the spectrum or other properties of a signal. Since a transform-domain representation of the signal has already been created, only a minimum of additional processing is required to format the data for presentation. A transform sum (e.g., constructed spectrum) may be displayed, as well as the magnitudes and frequencies of individual partials.

Furthermore, the spectral representation found in one or more of the transform sums may be used as real-time feedback to the control structure 500 to influence further generation of the same transform sum or the generation of a subsequent transform sum.

A transform domain filtering block 79 receives transform sums from the transform sum-and-mix block and is designed to perform various types of processing of the transform sums in the transform domain. The transform domain filtering block 79 is controlled by control signals from, and provides signals to, the control structure 79. The transform domain lends itself to readily performing various types of processing that can be performed in the time domain or the signal domain only with considerably greater difficulty and expense.

Transform domain processing allows accommodation of known perceptual mechanisms, as well as adaptation to constraints imposed by the environment in which the synthesized sound is to be heard. By way of example only, transform domain processing may be used to perform automatic gain control or frequency-dependent gain control. Similarly, simulations of auditory perception may be used to effectively "listen" to the sound representation before it is synthesized and then alter the sound representation to remove objectional sounds or perceptually orthogonalize the control parameter space.

Following transform domain processing, the sound representation is synthesized using a bank of inverse transform/overlap-add operations 73 to transform each transform sum. Each inverse transform IT indicated in FIG. 2 bears an approximate correspondence to the conventional inverse Fourier transform previously described. However, the inverse transform need not be a Fourier inverse transform, but may be a Hartley inverse transform or other appropriate inverse transform. The number of transforms computed, n.t., is limited only by the available computational power.

Time-sampled signals produced by the inverse transform/overlap-add bank 73 are input to an output matrix mix block 71. The output matrix mix block is realized in a conventional manner and is used to produce a number of output signals, n.o., which may be the same as or different than the number of transforms computed, n.t. The output signals are D-to-A converted and output to appropriate sound transducers.

The sound synthesis system described produces sounds from a parametric description. To achieve greater flexibility and generality, the blocks to the right of the dashed line 13 may be added. These blocks allow stored sounds, real-time sounds, or both, to be input to the system.

Sound signals that are transform coded are stored in a block 85. Under control of the control structure 500, these signals may be retrieved, transform decoded in a transform decode block 81, and added to one or more transform sums. The stored signals may represent pre-stored sounds, for example.

Real-time signals may be input to block 75, where they are forward transformed. A block 77 then performs transform filtering of the input signals. The filtered, transformed signals are then added to one or more transform sums under the control of the control structure 500.

In addition, the real-time signal and its transform may be input to a block 72 that performs analysis and system identification. System identification involves deriving a parametric representation of the signal. Results from an analyzed spectrum may be fed back to the control structure 500 and used in the course of construction of subsequent spectra or the modification of the current spectrum.

Figure 3B:
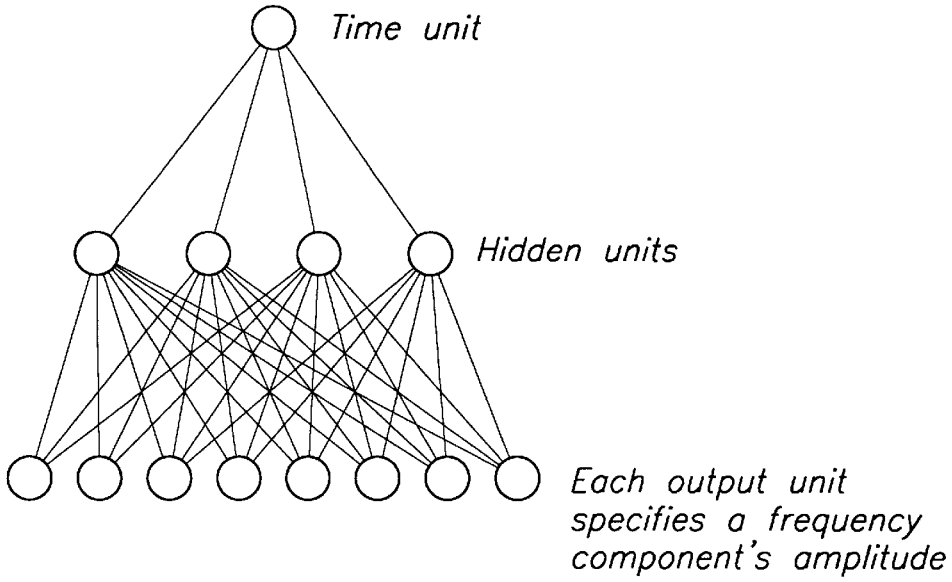
FIG. 3B is a diagram of a neural network that may be used as a control structure to produce parameters to be used in synthesis of the sound of FIG. 3A.
Figure 3A:
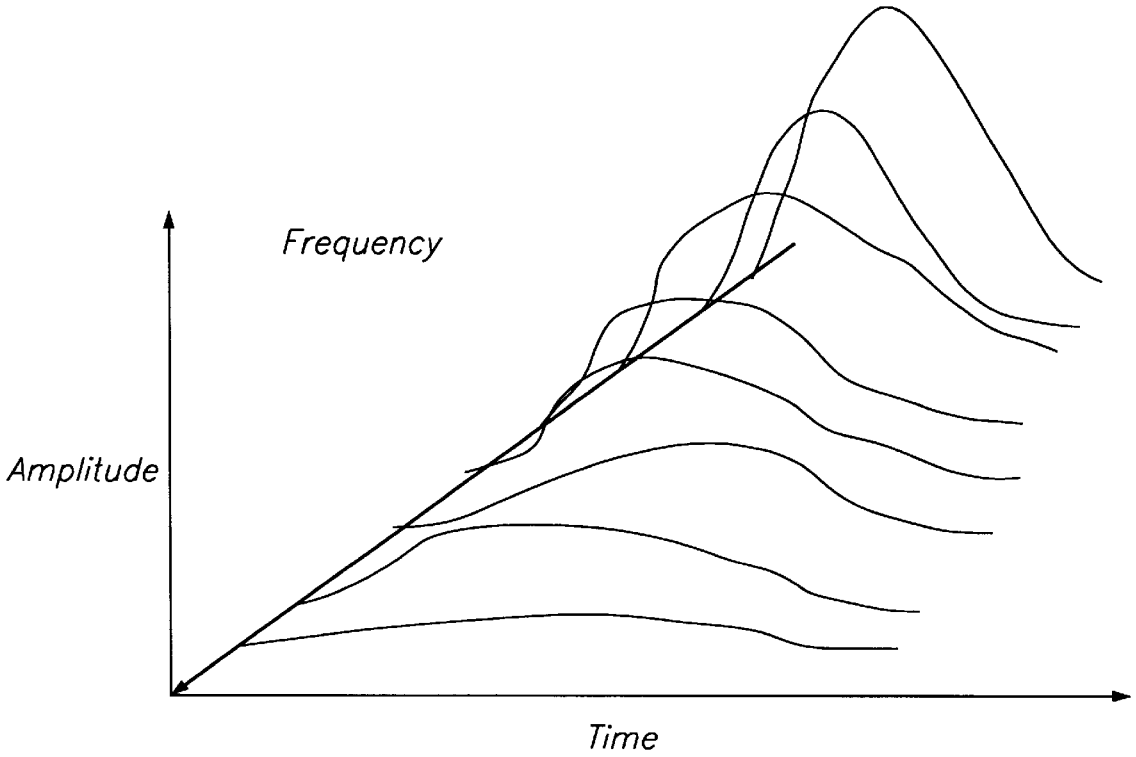
FIG. 3A is a graph showing the temporal evolution of partials making up a given sound.

The function of the control structure 500 of FIG. 2 may be more clearly understood with reference to FIG. 3A and succeeding figures. In order to control synthesis of a single sound of a given timbre, a control structure must be able to output the correct amplitudes for each partial within the sound (or at least the most significant partials) at each point in time during the sound. Some partials have relatively large amplitude and other partials have relatively small amplitudes. Partial of different frequencies evolve differently over time. Of course, in actual practice, time is measured discretely, such that the control structure outputs the amplitudes for the partials at each time increment during the course of the sound. A neural network of the general type shown in FIG. 3B may be used to "memorize" the temporal evolution of the partials for the sound and to produce data describing the sound. In particular, the neural network of FIG. 3B has a time input unit, a number of hidden units, and a number of output units equal to the number of partials in the sound to be synthesized. When a particular time increment is specified by inputting a corresonding time signal to the time unit, each output unit specifies a frequency component's amplitude during that time increment.

Figure 3D:
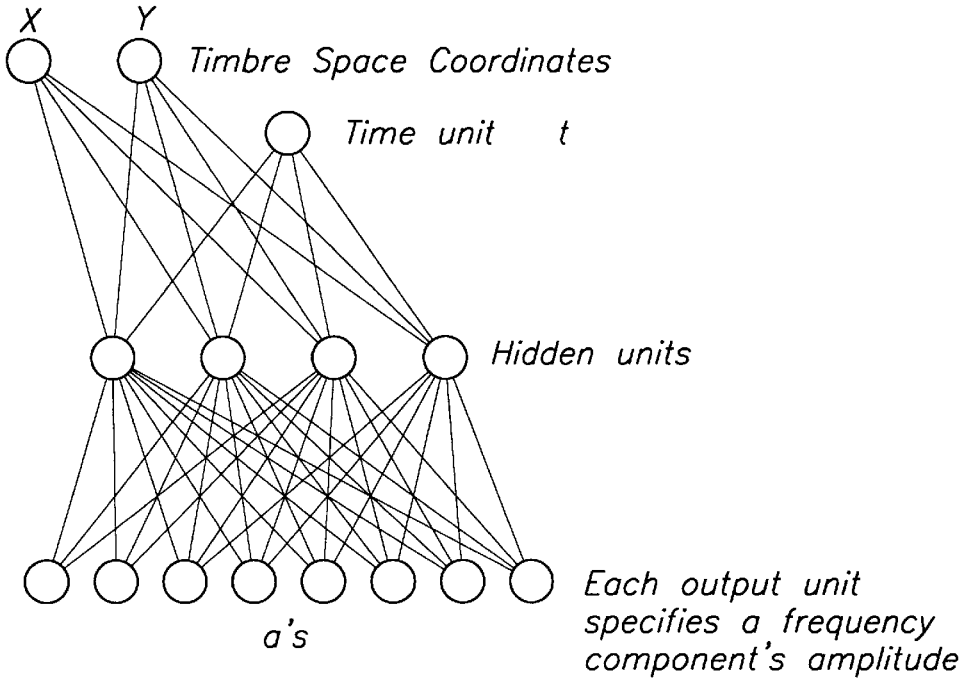
FIG. 3D is a diagram of a neural network that may be used as a control structure to produce parameters to be used in synthesis of the sounds of FIG. 3C.
Figure 3C:
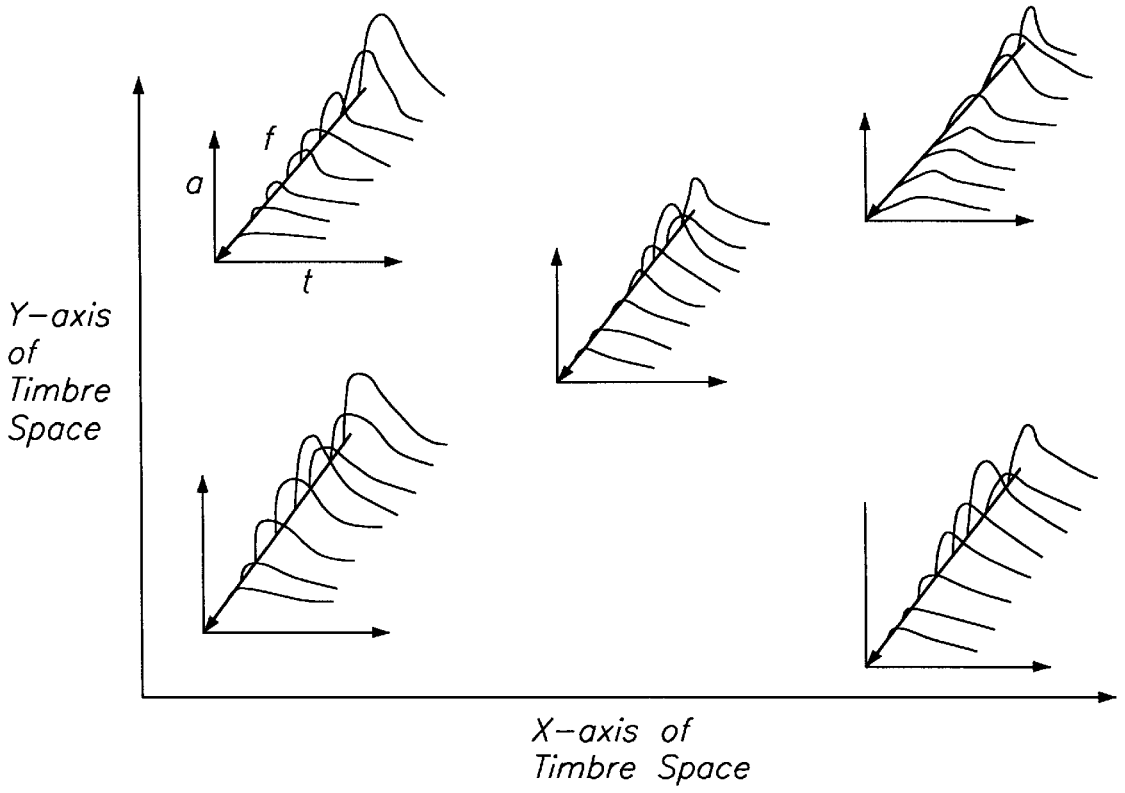
FIG. 3C is a collection of graphs showing the temporal evolution of partials making up similar sounds of different timbres within a timbre space.

To increase its versatility, the control structure of FIG. 3B may be generalized in order to produce data describing similar sounds in different timbres within a timbre space. Referring to FIG. 3C, the sound of FIG. 3A is now represented as a single sound within a family of sounds of different timbres. The sounds are arranged in a timbre space, a geometrical construct of the type previously described. A neural network of the general type shown in FIG. 3D is provided with additional inputs X and Y in its input layer to allow for specification of a point within the timbre space. The neural network may be used to "memorize" the temporal evolution of the partials for each sound and to produce data describing the appropriate sound of a selected timbre in accordance with the time input and the application of timbre space coordinates to the input nodes.

The apparent simplicity of providing a time input belies the remarkable increase (as compared to the prior art) in the power of the control structure that results, providing the power to control the synthesis of a broad universe of sounds. Single sounds as a result become very elastic, susceptible to being stretched or compressed in various ways without altering the quality of the sound. Furthermore, the time input allows for differences in the time bases of different sounds to be accounted for in order to produce sounds by interpolating between various other sounds, without producing artifacts. This feature is explained in greater detail hereinafter.

Figure 4B:
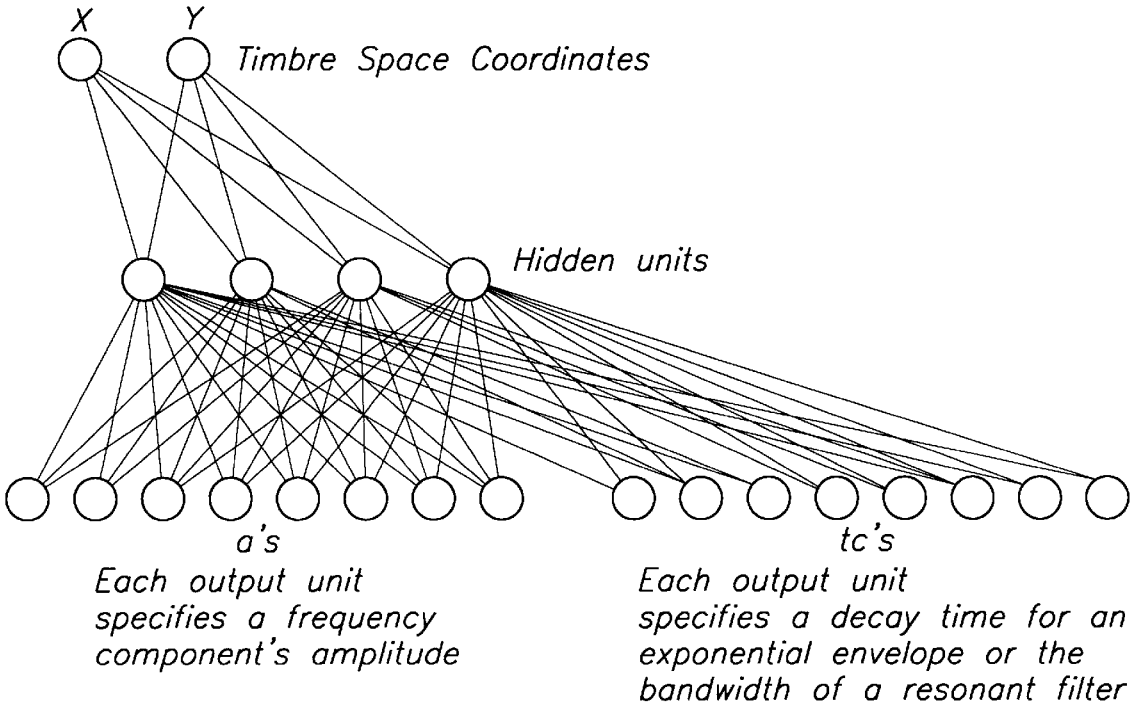
FIG. 4B is a diagram of a neural network that may be used as a control structure to produce parameters to be used in synthesis of the sounds of FIG. 4A.
Figure 4A:
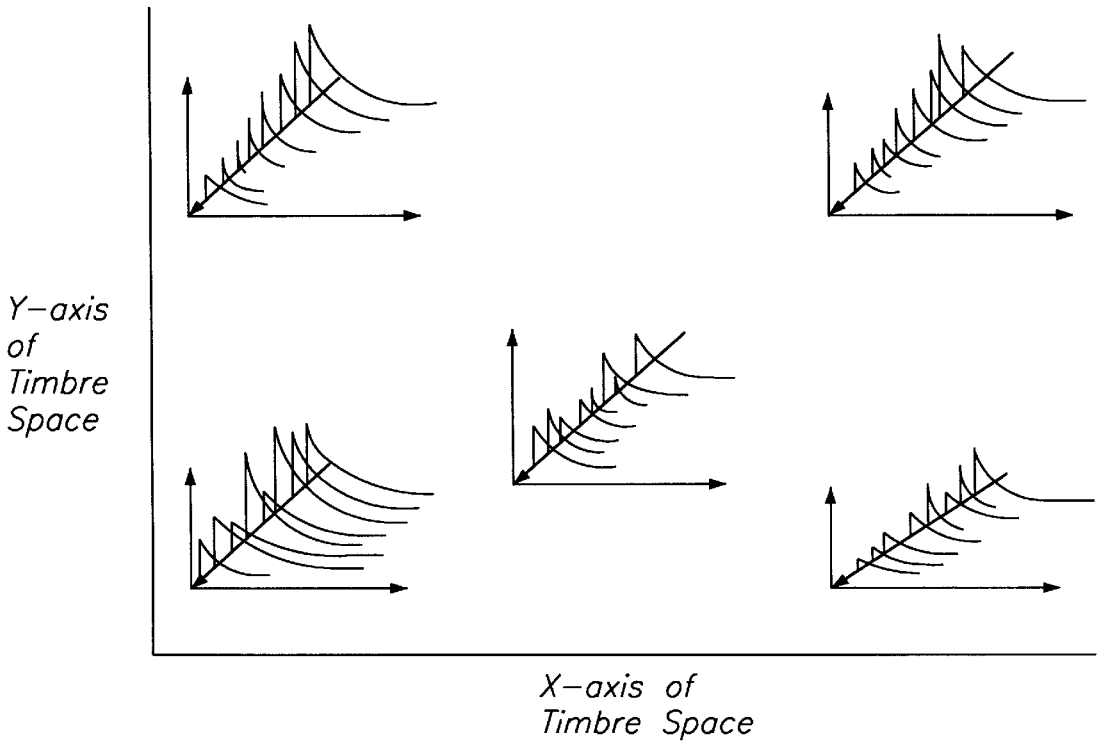
FIG. 4A is a collection of graphs showing the temporal evolution of partials making up similar sounds of different percussive timbres within a percussive timbre space.

The foregoing description has assumed that the sound to be synthesized is harmonic. The same method may be applied, however, to percussive sounds, as shown in FIG. 4A and FIG. 4B. Of course, percussive tones may have different timbres (e.g., the sound of drum as distinguished from the sound of a bell). FIG. 4A and FIG. 4B therefore show a percussive tone timbre space and a neural network having timbre space coordinate inputs, respectively. Note that partials rise almost instantaneously to respective peak values at the beginning of the sound (corresponding to a time when the percussive sound is struck) and then decay exponentially in accordance with a particular time constant. Each partial may be described throughout its duration in terms of an initial amplitude and a time constant. In the neural network of FIG. 4B, therefore, the input layer does not have a time input. The output layer produces an amplitude and a time constant for each partial.

Figure 5:
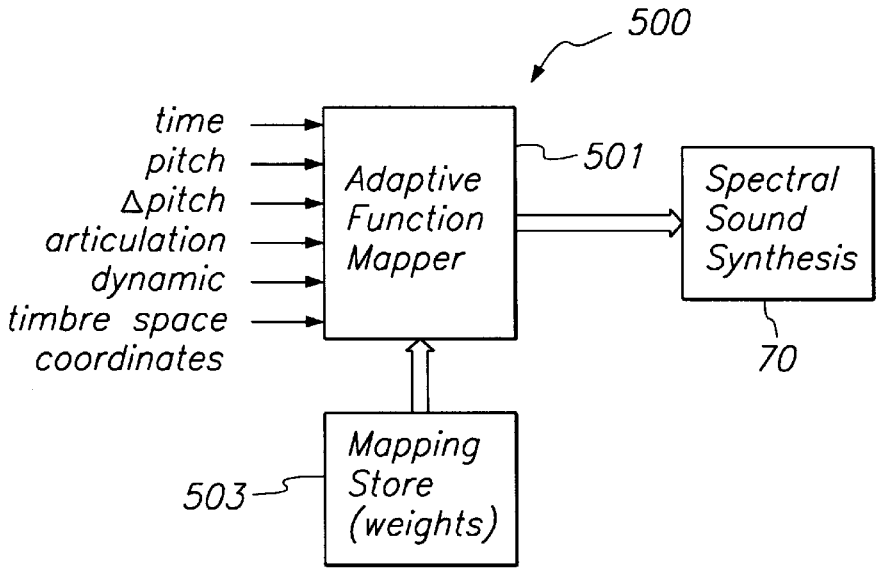
FIG. 5 is a block diagram of the control structure of FIG. 2.

Referring now to FIG. 5, the control structure 500 of FIG. 2 will be described in greater detail. The control structure 500 is realized in the form of an adaptive function mapper 501. In a preferred embodiment, the adaptive function mapper 501 is a neural network. In other embodiment, the adaptive function mapper 501 may take the form of a fuzzy logic controller, a memory-based controller, or any of a wide variety of machines that exhibit the capability of supervised learning.

Basically, the role of the adaptive function mapper 501 is to map from control parameters within a low-dimensional control parameter space to synthesis parameters within a high-dimensional synthesis parameter space. This mapping is performed in accordance with data stored in a mapping store 503. In particular, the mapping store 503 contains weights applied to various error terms during supervised learning and changed in accordance with a supervised learning procedure until an acceptable error is achieved. The adaptive function mapper 501 will then have been trained and may be used in "production mode" in which different combinations and patterns of control parameters are applied to the adaptive function mapper 501 in response to the gestures of a user. The adaptive function mapper 501 maps from the control parameters to synthesis parameters which are input to a spectral sound synthesis process 70 (such as the one shown in FIG. 2) in order to synthesize a corresponding pattern of sounds.

In a preferred embodiment, the control parameters include the following:

TABLE I

| CONTROL PARAMETER | DESCRIPTION |
|---|---|
| time (canonical) | An identifier of the temporal progression of a sound relative to a sound template having different phases such as attack, sustain, release. |
| pitch | The "note" to be played. |
| Δpitch | A pitch offset. May be used to sharpen a note or flatten a note or varied up and down to achieve a vibrato effect. |
| dynamic | How loud or how soft the note is to be played. |
| articulation | A discription of a desired transition from one note to the next terms of 1) the pitch of the previous note; 2) the dynamic of the previous note; and 3) the time between the release point of the previous note and the attack of the present note. |
| timbre space coordinates | Identify a point in a timbre space, preferably a perceptually uniform timbre space. May identify a point corresponding to a real instrument (oboe, trumpet, etc.) or an intermediate point having a synthetic timbre. |

Figure 1:
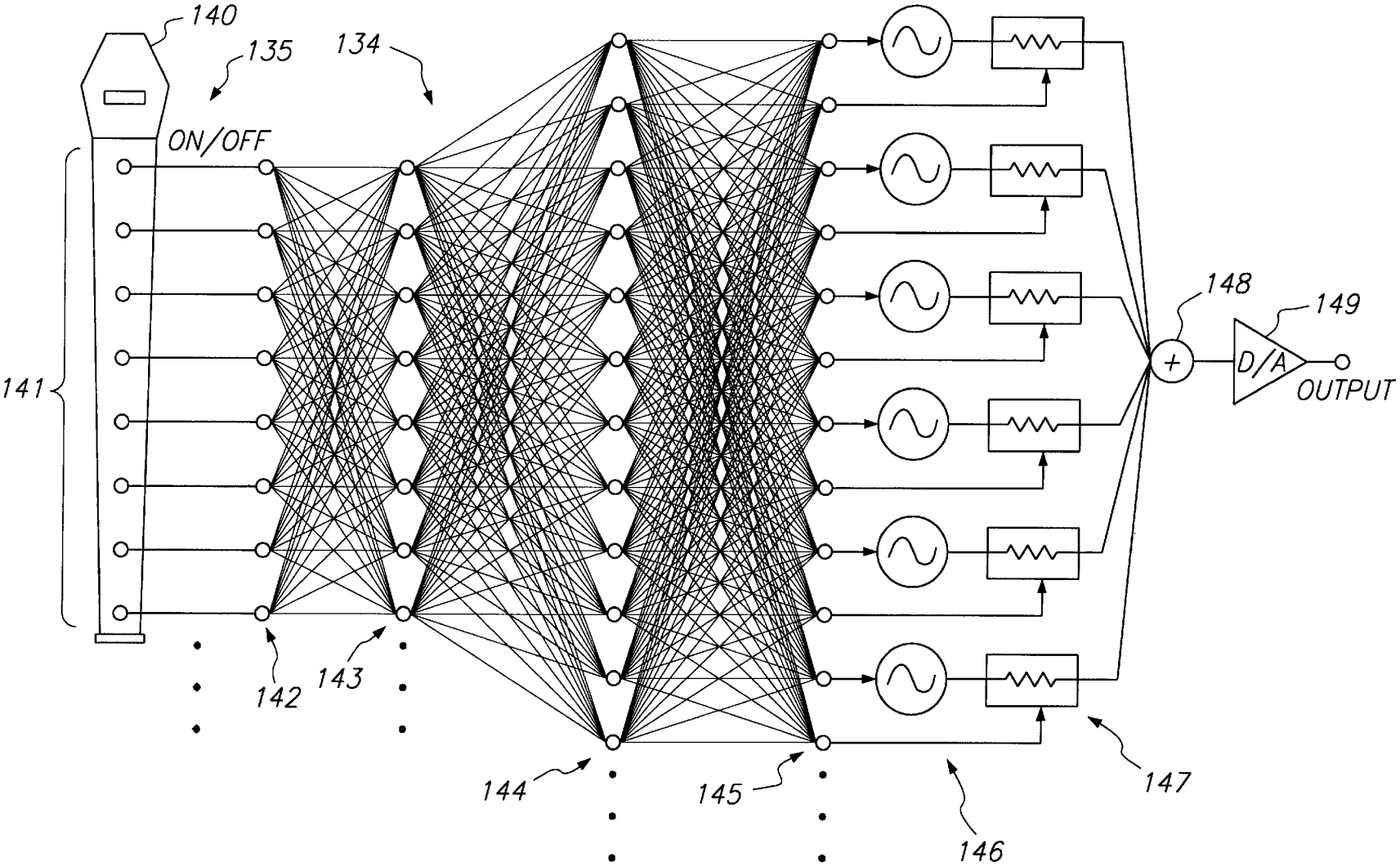
FIG. 1 (PRIOR ART)
FIG. 1 is a diagram of a conventional electronic musical instrument using a neural network.

The organization represented by the foregoing control parameters is of quite fundamental significance in several respects. First, with respect to the purely musical parameters of pitch, Δpitch, articulation and dynamic, only pitch and dynamic are incorporated into simpler prior art models such as that of FIG. 1. Implicit in FIG. 1 is the musical parameter of instrument, corresponding to a single point in timbre space, or possibly one of multiple points in timbre space each corresponding to a real instrument. Without accounting for Δpitch and articulation, there can be produced only very simple musical expressions of detached notes played in one or maybe a few real timbres without vibrato or any similar effect. Furthermore, the manner in which Δpitch and articulation might be accounted for is not at all apparent from conventional models.

Second, with respect to the parameters of time and timbre space coordinates, these parameters are not musical parameters in the traditional sense, in that they represent properties that can only be controlled using a digital computer. The time parameter represents time in intervals of a few milliseconds, an interval finer than the ability of the human ear to perceive, and furthermore represents canonical time, thereby providing a common time base between different sounds. Unlike real time, which progresses forward at a fixed rate, canonical time may be advanced, retarded, or frozen. The ability to freeze time allows for a considerable reduction to be achieved in the volume of training data required, since synthesis parameters corresponding to a single frame of steady-state sample data can be held indefinitely. The timbre space parameters specify not only real instruments but also an infinitude of virtual instruments, all arrayed in such a manner as to be intelligently manipulated by a user.

In a preferred embodiment, the synthesis parameters output by the adaptive function mapper 501 are those employed by the spectral sound synthesis process 70 of FIG. 2. That is, the adaptive function mapper 501 outputs an amplitude signal for each of a multitude of partials. The adaptive function mapper 501 also outputs signals specifying a noise part of the sound, including signals specifying broadband noise and signals specifying narrowband noise. For broadband noise, the adaptive function mapper 501 outputs a noise amplitude signal for each of a number of predetermined noise bands. For narrowband noise, the adaptive function mapper 501 outputs three signals for each narrowband noise component: the center frequency of the noise, the noise bandwidth, and the noise amplitude. The adaptive function mapper 501 may be configured to output only a single narrowband noise component or may be configured to output multiple narrowband noise components. The output of the adaptive function mapper 501 may therefore be represented as follows:

$$a_1, a_2, \ldots, a_n, \text{Noise part (Broadband) (Narrowband)},$$

where $a_i$ represents the amplitude of a partial.

Figure 6:
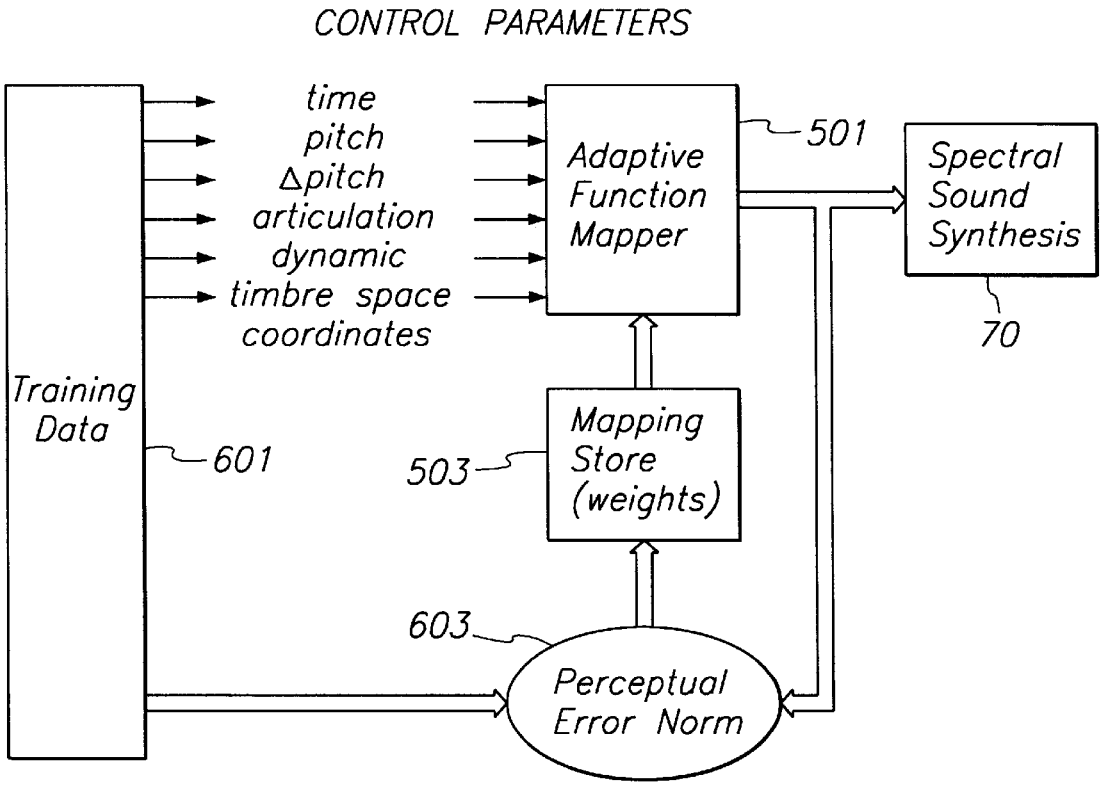
FIG. 6 is a block diagram of the control structure of FIG. 2 as configured during training.

The adaptive function mapper 501 is trained on "live" examples, that is sounds captured from playing of a real instrument by a live performer. The training data is prepared in a systematic fashion to ensure the most satisfactory results. The preparation of the training data will therefore be described prior to describing the actual training process (FIG. 6).

An object of training is to populate the timbre space with points corresponding to a variety of real instruments. In between these points the adaptive function mapper is then able to, in effect, interpolate in order to create an almost infinite variety of synthetic timbres. Therefore, recording sessions are arranged with performers playing real instruments corresponding to points located throughout the timbre space. The instrument may be an oboe, a french horn, a violin, etc. The instrument may also be a percussion instrument such as a bell or a drum, or even the human voice. During a session, the performer wears headphones and is asked to play, sing, or voice scales (or some other suitable progression) along with a recording of an electronic keyboard, matching the recording in pitch, duration and loudness. The scales traverse substantially the entire musical range of the instrument, for example three octaves.

By conducting repeated such sessions with a variety of instruments, live samples are obtained corresponding to points throughout most of the control parameter space, i.e., the portion of the control parameter space characterized by timbre, pitch, loudness and Δpitch. Note that the Δpitch parameter is ignored during the recording session. The Δpitch parameter may be ignored during recording because it is a derivative parameter related to the pitch parameter, which is accounted for during performance. The Δpitch parameter must be accounted for after performance and before training. This accounting for Δpitch is done, in approximate terms, by analyzing pitch changes during performance and "adding a Δpitch track" to the recording describing the pitch changes. Explicitly accounting for Δpitch makes it possible, for example, for a performer to use vibrato during a recording session, as experienced performers will almost inevitably do, but for that vibrato to be removed if desired during synthesis.

The samples obtained in the manner described thus far are detached samples, i.e., samples played in the detached style in which the previous note has decayed to zero before the next note is begun. The other chief articulation style is legato, or connected. The performer is therefore asked to played various note combinations legato, over small note intervals and over large note intervals, as well as in the ascending and descending directions. The articulation parameter dimension of the control parameter space will typically be sampled sparsely because of the vast number of possible combinations. Nevertheless, a complete set of articulation training examples may be obtained by "cutting and pasting" between samples in the following manner.

Figure 8A:
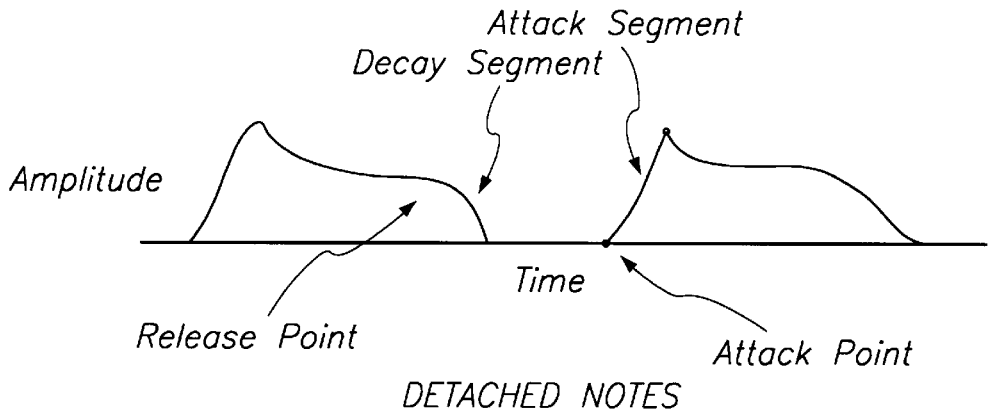
FIG. 8A is a graph of the temporal evolution of two successive notes played in a detached style.

Referring to FIG. 8A, performance examples may have been obtained for two different notes each played in a detached manner. Because the articulation parameter dimension of the control parameter space is sampled sparsely, no performance example may have been obtained of the same two notes played in close succession in a more attached style. Such a performance example may be constructed, however, from the performance examples of the two different notes each played in a detached manner. Such construction requires that the decay segment of the first note be joined to the attack segment of the second note in a smooth, realistic-sounding manner.

Figure 8B:
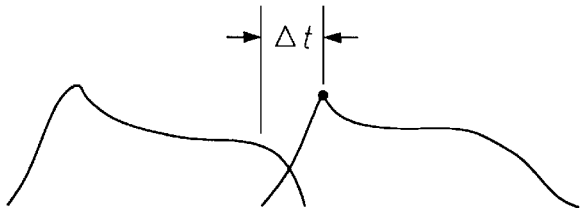
FIG. 8B is a modified version of the graph of FIG. 8A, showing how a smooth transition between the two notes may be constructed in order to simulate playing of the notes in a more attached style.

The nature of the transition will depend primarily on the desired articulation and on the timbre of the notes. That is, the shape of the transition will depend on whether the notes are those of a violin, a trombone, or some other instrument. By observing analysis results of various articulation examples in various timbres, appropriate transition models may be derived for constructing transition segments using the amplitudes of partials from the decay segment of the first note and the amplitudes of partials from the attack segment of the second note. A further input to the transition model is the parameter Δt describing the desired articulation, shown in FIG. 8B as the time from the release point of the first note to the decay point of the second note.

After a sufficient set of articulation examples is obtained, either by live performance, construction as described above, or typically some combination of the same, each sound in the resulting library of sounds is then transformed using short-term-Fourier-transform-based spectral analysis as described in various ones of the previously cited patents. The sounds are thus represented in a form suitable for synthesis using the spectral sound synthesis process 70. Before training can begin, the sound files must be further processed 1) to add Δpitch information as previously described; 2) to add segmentation information, identifying different phases of the sound in accordance with the sound template; and 3) to add time information. Theese steps may be automated to a greater or lesser degree. The third step, adding information concerning canonical time, or normalized time, to each of the sounds, is believed to represent a distinct advance in the art.

Figure 9A:
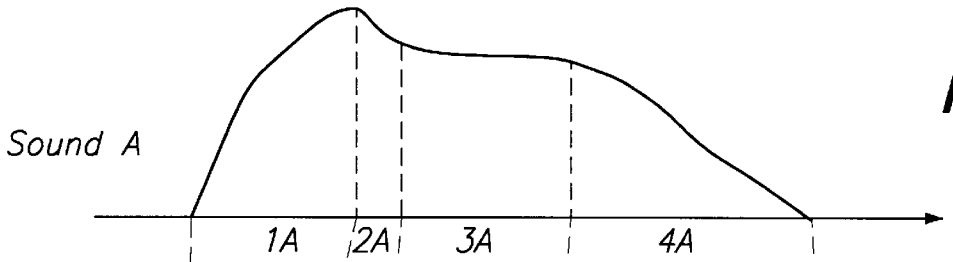
FIG. 9A and FIG. 9B are graphs of the evolution of the overall amplitudes of two sounds, showing how the two sounds may be mapped to a common time base.
Figure 9B:
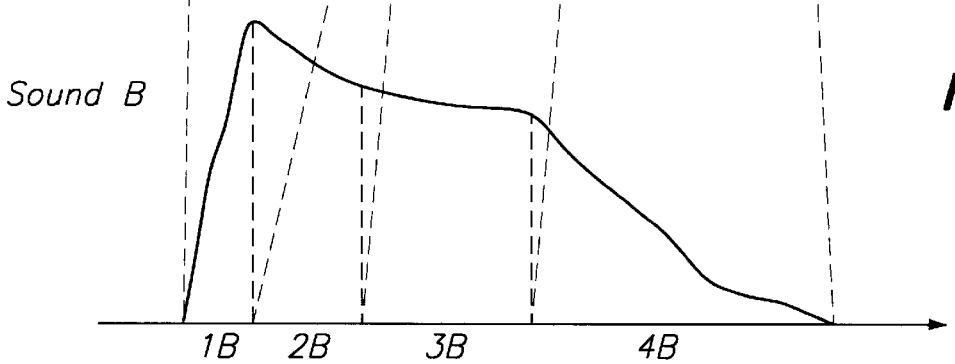

In order to establish the relationship between real time and the common time base called canonical time, a common segmentation must be specified for the different tones involved. Segmentation involves identifying and marking successive temporal regions of the sounds, and may be performed manually or, with more sophisticated tools, automatically. In FIG. 9A and FIG. 9B, sound A and sound B have a common segmentation in that the various segments, 1, 2, 3 and 4 can be associated with each other. Canonical time is calculated by determining the proportion of real time that has elapsed in a given segment. Following this method, the canonical time at the beginning of a segment is 0.0 and at the end 1.0. The canonical time halfway through the segment is 0.5. In this manner, any given point in real time can be given a canonical time by first identifying the segment containing the time point and then by determining what proportion of the segment has elapsed.

Following post-processing of the sound files in the manner described above, training of the adaptive function mapper 501 may begin. For this purpose, all of the sound files are concatenated into one large training file. Training may take several hours, a day, or several days depending on the length of the training file and the speed of the computer used.

Referring to FIG. 6, during training, control parameters for each frame of training data stored in a store 601 are applied in turn to the adaptive function mapper 501. At the same time, the corresponding synthesis parameters, also stored in the store 601, are applied to a perceptual error norm block 603. The output signals of the adaptive function mapper 501 produced in response to the control parameters are also input to the perceptual error norm block 603. A perceptual error norm is calculated in accordance with the difference between the output signals of the adaptive function mapper 501 and the corresponding synthesis parameters. Information within the mapping store is varied in accordance with the perceptual error norm. Then a next frame is processed. Training continues until an acceptable error is achieved for every sound frame within the training data.

In an exemplary embodiment, the adaptive function mapper 501 is realized as a neural network simulated on a Silicon Graphics Indigo™ computer. In one example, the neural network had seven processing units in an input layer, eight processing units in an intermediate layer, and eighty output units in an output layer, with the network being fully connected. In the same example, the neural network was trained using the well-known back propagation learning algorithm. Of course, other network topologies and learning algorithms may be equally or more suitable. Furthermore, various other types of learning machines besides neural networksmay be used to realize the adaptive function mapper 501.

Note in FIG. 6 that the error norm computed by the block 603 is a perceptual error norm, i.e., an error norm in which at least some error contributions are weighted in approximate degree to which they are perceived by the human ear during synthesis. Not all errors are perceived equally by the human ear. Hence, training to eliminate errors that are perceived by the human ear barely if at all is at best wasted effort and at worst may adversely affect performance of the adaptive function mapper 501 in other respects. By the same token, training to eliminate errors that are readily perceived by the human ear is essential and must be performed efficiently and well.

In a preferred embodiment, the perceptual error norm computed by the block 603 mimics human auditory perception in two different ways. First, errors are weighted more heavily during periods of considerable change and are weighted less heavily during periods of little change. Second, errors are weighted more heavily at high frequencies than at lower frequencies, in recognition of the fact that the human ear perceives errors in the high frequency range more acutely. The former is referred to as temporal envelope error weighting and the latter is referred to as frequency dependent error weighting. With regard to frequency dependent error weighting, in one experiment, for example, partials were successively added within a set frequency interval to form a resulting succession of sounds, each more nearly indistinguishable from the previous sound, first in a low frequency range and then in a high frequency range. In the low frequency range, after only a few partials, the successive sounds became indistinguishable. In the high frequency range, several tens of partials were added before the successive sounds became indistinguishable, demonstrating that the ear is very sensitive to fine structure in the high frequency range.

Figure 7:
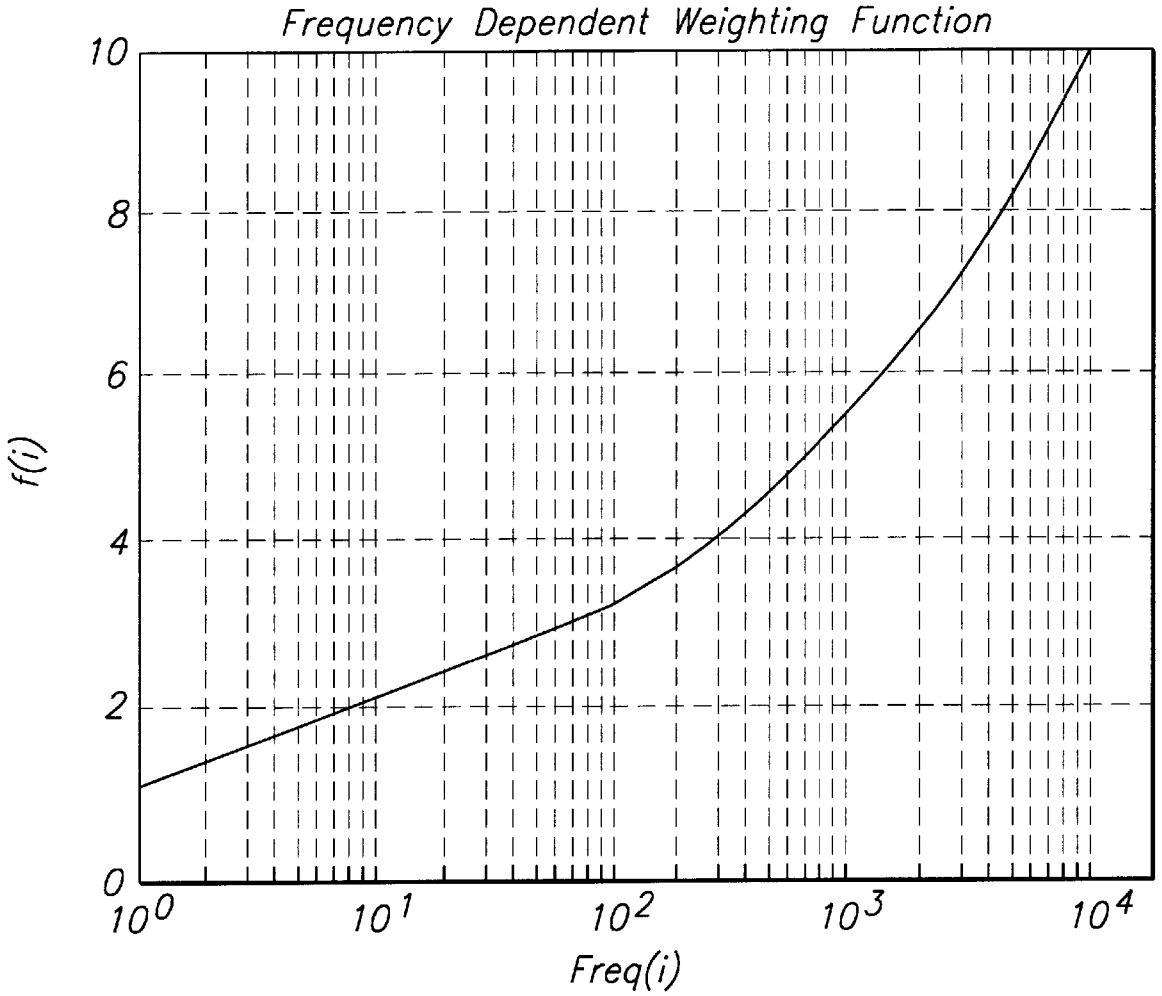
FIG. 7 is a graph of a frequency dependent weighting function used during training.

More particularly, in a preferred embodiment, the error with respect to each output signal of the adaptive function mapper 501 is calculated in accordance with the following equation:

$$\text{error} = \Sigma g\left(\frac{d}{dt}\,(RMS)\right) f(Freq(i))\,(a_i - \hat{a}_i)^2$$

where $a_i$ is the desired synthesis parameter, $\hat{a}_i$ is the corresponding output signal of the adaptive function mapper 501, RMS is the error envelope, and f and g represent monotonic increasing functions. The exact form of the functions f and g is not critical. The graph of an example of a function f that has been found to yield good results is shown in FIG. 7.

It will be appreciated by those of ordinary skill in the art that the invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

What is claimed is:

1. A method of producing sound data for a desired sound having a temporal progression, comprising the steps of:

applying to an adaptive function mapper control parameters including:

a time parameter, said time parameter specifying from among an ordered sequence of points a particular point within said temporal progression; and at least one parameter selected from the set of timbre space coordinates, pitch, Δpitch, articulation and dynamic; and using the adaptive function mapper, mapping from the control parameters to synthesis parameters to be applied to a sound synthesizer.

2. The method of claim 1, wherein the adaptive function mapper effects a several-fold multiplication in the number of parameters from the control parameters to the synthesis parameters.

3. The method of claim 1, wherein the time parameter is canonical time, derived by warping real time with respect to a plurality of sound samples to a common time base.

4. The method of claim 1, wherein the timbre space coordinates are coordinates within a perceptually uniform timbre space.

5. The method of claim 1, wherein the adaptive function mapper is a neural network.

6. The method of claim 1, wherein the adaptive function mapper is a simulated neural network.

7. The method of claim 1, wherein the synthesis parameters are to be applied to an additive sound synthesizer and include amplitudes of partials.

8. The method of claim 7, wherein the synthesis parameters are to be applied to an inverse FFT additive sound synthesizer and include, in addition to the amplitudes of partials, noise parameters.

9. The method of claim 8, wherein the noise parameters include broadband noise parameters and narrowband noise parameters.

10. A method of training an adaptive function mapper to produce, in accordance with information stored in a mapping store, synthesis parameters to be applied to a sound synthesizer, the method comprising the steps of:

analyzing sounds to produce sound parameters describing the sounds;

further analyzing the sound parameters to produce control parameters;

applying the control parameters to the adaptive function mapper, the adaptive function mapper in response producing trial synthesis parameters comparable to the sound parameters;

deriving from the sound parameters and the trial synthesis parameters an error measure in accordance with a perceptual error norm in which at least some error contributions are weighted in approximate degree to which an analytical model of human auditory perception predicts that they will be perceived by the human ear during synthesis; and adapting the information stored in the mapping store in accordance with the error measure.

11. The method of claim 10, wherein the error contributions are weighted in accordance with a monotonically increasing, frequency-dependent weighting function.

12. The method of claim 11, wherein the error contributions are further weighted in accordance with a monotonically increasing function of a time derivative of the error measure.

13. The method of claim 10, wherein the control parameters include:

at least one parameter selected from the set of time and timbre space coordinates; and at least one parameter selected from the set of pitch, Δpitch, articulation and dynamic.

14. The method of claim 13, wherein the time parameter is canonical time, derived by warping real time with respect to a plurality of sound samples to a common time base.

15. The method of claim 13, wherein the timbre space coordinates are coordinates within a perceptually uniform timbre space.

16. The method of claim 10, wherein the adaptive function mapper effects a several-fold multiplication in the number of parameters from the control parameters to the synthesis parameters.

17. The method of claim 10, wherein the adaptive function mapper is a neural network.

18. The method of claim 10, wherein the adaptive function mapper is a simulated neural network.

19. The method of claim 10, wherein the synthesis parameters are to be applied to an additive sound synthesizer and include amplitudes of partials.

20. The method of claim 19, wherein the synthesis parameters are to be applied to an inverse FFT additive sound synthesizer and include, in addition to the amplitudes of partials, noise parameters.

21. The method of claim 20, wherein the noise parameters include broadband noise parameters and narrowband noise parameters.

22. An apparatus for producing sound data for a desired sound having a temporal progression, comprising:

an adaptive function mapper;

means for applying to the adaptive function mapper control parameters including:

at least one parameter selected from the set of time and timbre space coordinates; and at least one parameter selected from the set of pitch, Δpitch, articulation and dynamic; and the adaptive function mapper comprising means for mapping from the control parameters to synthesis parameters to be applied to a sound synthesizer;

wherein said time parameter specifies from among an ordered sequence of points a particular point within said temporal progression.

23. An apparatus for producing synthesis parameters to be applied to a sound synthesizer, the apparatus comprising:

an adaptive function mapper;

a mapping store coupled to the adaptive function mapper means for analyzing sounds to produce sound parameters describing the sounds;

means for further analyzing the sound parameters to produce control parameters;

means for applying the control parameters to the adaptive function mapper, the adaptive function mapper in response producing trial synthesis parameters comparable to the sound parameters;

means for deriving from the sound parameters and the trial synthesis parameters an error measure in accordance with a perceptual error norm in which at least some error contributions are weighted in approximate degree to which an analytical model of human auditory perception predicts that they will be perceived by the human ear during synthesis; and means for adapting the information stored in the mapping store in accordance with the error measure.

24. A method of producing sound data, comprising the steps of:

applying to an adaptive function mapper a trigger input signal; and using the adaptive function mapper, producing synthesis parameters to be applied to a sound synthesizer, said synthesis parameters including a time constant representative of a decaying exponential function of time.

25. The method of claim 24, wherein the adaptive function mapper effects a several-fold multiplication in the number of parameters from the control parameters to the synthesis parameters.

26. The method of claim 24, wherein the timbre space coordinates are coordinates within a perceptually uniform timbre space.

27. The method of claim 24, wherein the adaptive function mapper is a neural network.

28. The method of claim 24, wherein the adaptive function mapper is a simulated neural network.

29. The method of claim 24, wherein the synthesis parameters are to be applied to an additive sound synthesizer and include amplitudes of partials.

30. The method of claim 24, wherein amplitudes of partials and time constants are produced in one-to-one correspondence.

* * * * *